US005619235A

United States Patent [19]

Suzuki

[11] Patent Number: 5,619,235

[45] Date of Patent: Apr. 8, 1997

[54] ENERGY EFFICIENT INK JET PRINT HEAD

[75] Inventor: Masahiko Suzuki, Nagoya, Japan

[73] Assignee: Brother Kogyo Kabushiki Kaisha, Aichi-ken, Japan

[21] Appl. No.: 313,816

[22] Filed: Sep. 28, 1994

[30] Foreign Application Priority Data

Sep. 30, 1993 [JP] Japan ..... 5-244903

[51] Int. Cl.[6] ..... B41J 2/045

[52] U.S. Cl. ..... 347/69; 347/71; 347/68

[58] Field of Search ..... 347/69, 68, 71; 310/330–334, 358

[56] References Cited

U.S. PATENT DOCUMENTS

| | | | |
|---|---|---|---|
| 5,016,028 | 5/1991 | Temple | 347/69 |
| 5,036,241 | 7/1991 | Michaelis et al. | 310/358 |
| 5,193,256 | 3/1993 | Ochiai et al. | 347/71 |

FOREIGN PATENT DOCUMENTS 2-150355 6/1990 Japan .

*Primary Examiner*—Benjamin R. Fuller
*Assistant Examiner*—Charlene Dickens
*Attorney, Agent, or Firm*—Oliff & Berridge

[57] ABSTRACT

An actuator is made from a piezoelectric ceramic substrate and an alumina ceramic substrate. The alumina ceramic substrate is made from a material with a dielectric constant that is lower than the piezoelectric material from which the piezoelectric ceramic substrate is made. Using a diamond cutter blade, the actuator is formed with channel groove portions cut in the piezoelectric ceramic substrate, and sloping groove portions and shallow groove portions cut in the alumina ceramic substrate. Metal electrodes are vapor deposited at the inner surface of the shallow groove portions, on the side walls and a portion of the floor of the sloping groove portions, and on the side walls of the channel groove portions. Ink is ejected by deforming the side walls at the channel groove portions, which are made the piezoelectric ceramic substrate. Because the capacitance of the sloping groove portions and the shallow groove portions is small, only a small amount of energy need be inputted to eject ink droplets.

12 Claims, 8 Drawing Sheets

ENERGY EFFICIENT INK JET PRINT HEAD

BACKGROUND OF THE INVENTION

1. Field of the Invention

The present invention relates to a print head used in an ink jet printer.

2. Description of the Related Art

There are two major categories of conventional dot-on-demand print heads for ink jet printers. One category includes print heads with thermal elements (that is, elements for converting electric energy to heat energy) and the other category includes print heads with piezoelectric elements (that is, elements for converting electric energy into mechanical energy). As is well known, thermal elements are used in print heads to directly heat the ink, or other material to be ejected from the print head, in order to generate a vapor bubble. Ink is ejected from nozzles in the print head by the force of expanding bubbles. Not all materials are well adapted for this heating process, so not all materials can be ejected from print head that use thermal elements.

No such restrictions exist for materials to be ejected from print heads that use piezoelectric elements. Print heads that use piezoelectric elements also have the advantage of being durable. On the other hand, print heads that use piezoelectric elements can not be produced using semiconductor production techniques. Therefore, print heads with piezoelectric elements can not be produced in as compact and integrated a form as print heads with thermal elements.

Japanese Patent Application Kokai No. HEI-2-150355 describes a print head wherein pressure for ejecting ink is generated using motion created when piezoelectric material deforms in the shear mode. The resultant print head has a compact and a highly integrated structure.

FIG. 1A shows an ink jet print head 1 described in the Japanese Patent Application Kokai No. HEI-2-150355. Directional terms such as "upper," "lower," "front," and the like used in the following explanations refer to the ink jet print head 1 when in the posture shown in FIG. 1A. The ink jet print head 1 includes a piezoelectric ceramic plate 2, a cover plate 3, a nozzle plate 31, and a substrate 41. The print head 1 is provided with a plurality of ink chambers 12 (see FIG. 5), each of which is defined by two adjacent side walls 11, the floor of a groove 8 defined between the two adjacent side walls, a surface of the nozzle plate 31, and a surface of the cover plate 3.

More specifically, the piezoelectric ceramic plate 2 is formed with a plurality of grooves 8 extending parallel to one another. As shown in FIGS. 1B, 1C and 2, each groove 8 includes a channel groove portion 17, a sloping groove portion 19, and a shallow groove portion 16. Metal electrodes 13, 18, and 9 are provided in connection in each groove 8. A metal electrode 13 is provided at the channel groove portion 17 of each groove 8 on the upper half of opposing side surfaces of two adjacent side walls 11 that sandwich groove 8 therebetween. A metal electrode 18 is provided at the sloping groove portion 19 of each groove 8 on the upper portion of opposing side surfaces of the two adjacent side walls 11 that sandwich groove 8 therebetween. The metal electrode 18 has the same width as the metal electrode 13. The metal electrode 18 is also provided to an upper portion of the floor of the sloping groove portion 19 of each groove 8. The metal electrode 9 is provided, at the shallow groove portion 16 of each groove 8, to completely cover the opposing side surfaces of the two adjacent side walls 11 that sandwich groove 8 therebetween and the floor of the shallow groove portion 16.

The substrate 41 is attached to the base of the piezoelectric ceramic plate 2. Conductor layer patterns 42 are provided to the substrate 41 at positions thereof corresponding to positions of each groove 8. Conductor wires 43 are provided to connect one end of each conductive layer pattern 42 with its respective metal electrode 9 formed at the floor of the shallow groove portion 16. As shown in FIG. 4, the other ends of the conductive layer patterns 42 are connected to an LSI chip 51 by wires. A clock line 52, a data line 53, a voltage line 54, and an earth line 55 are also connected to the LSI chip 51.

With this structure, the channel groove portion 17 and the sloping groove portion 19 of each groove 8, sandwiched between two adjacent side walls 11, defines an ink chamber 12 for being filled with ink. A pair of opposing side surfaces of the two adjacent side walls 11 defining each ink chamber 12 therebetween are provided with opposing metal electrodes 13 and 18. The metal electrode 18 is also provided in an upper portion of a floor of the sloping groove portion 19 of each ink chamber 12. Each shallow groove portion 16 is formed, at a portion close to an end 15 of the plate 2, in correspondence with each ink chamber 12 to be provided with a metal electrode 9 for electrically connecting each conductive layer pattern 42 to the opposing metal electrodes 13 and 18 provided at the corresponding ink chamber 12. It is noted that the sloping groove portion 19 is inevitably formed when the ink channel groove portion 17 and the shallow groove portion 16 for each ink chamber 12 are produced through dicing technique, as will be described below.

The following is an explanation of a method for manufacturing the ink jet print head 1. As shown in FIG. 2, the piezoelectric ceramic plate 2 is formed from a plate of lead zirconium titanate (PZT), a ferroelectric ceramic material, that is polarized in the direction indicated by the arrow 5. Grooves 8 are cut in the plate with a rotating diamond cutter blade 30 in a dicing technique. To form the channel groove portions 17, the sloping groove portions 19, and the shallow groove portions 16 in the grooves 8, the diamond cutter blade 30 is first caused to cut into the plate in the direction indicated by arrow 30A to form the channel groove portion 17. After the diamond cutter blade 30 travels in the direction indicated by arrow 30A for a predetermined distance, the cutting direction is changed to the direction indicated by arrow 30B, thereby reducing the cutting depth. The sloping portion 19 is formed at this time to a curved surface with substantially the same curvature as that of the diamond cutter blade 30. The cutting direction is then changed to that indicated by arrow 30C to form the shallow portion 16. Adjacent grooves 8 are separated by side walls 11, which are polarized in the direction indicated by arrow 5.

As shown in FIG. 1A, the piezoelectric ceramic plate 2 is thus formed with a plurality of grooves 8 all cut in parallel to an equal depth. The dimensions of the channel groove portions 17 and the shallow groove portions 16 are determined by the thickness of the diamond cutter blade 30 and the amount to which the diamond cutter blade 30 is set to cut into the plate. The pitch of the grooves 8 is determined by control of the feed pitch of the process table, and the number of grooves 8 is determined by the number of times the plate is cut. The curvature of the sloping groove portion 19 is determined by the radius of the diamond cutter blade 30. Because the process is commonly used in manufacturing semiconductors, extremely thin diamond cutter blades 30 with thickness of 0.02 mm are sold on the market. Therefore, the print head 20 can be made with sufficiently high integration.

As shown in FIG. 3, to form the metal electrodes 13, 18, and 9, the piezoelectric ceramic plate 2 with grooves 8 formed therein is tilted at an angle in relation to the direction B in which vapor travels from the deposition source (not shown). This tilt places one side wall 11 defining each groove 8 entirely in a shadow with respect to the direction B. The floor and the lower half of the other side wall 11 are also in a shadow at the channel groove portion 17. At the sloping groove portion 19, the lower portion of the other side wall 11 and the lower portion of the sloping floor are also in a shadow. Therefore, metal from metal vapor released in direction B deposits only on surfaces that are not in shadowed regions. As a result, a metal electrode 10 is formed on the top surface of all side walls 11; a metal electrode 13 is formed on the upper half of the unshadowed side of each side wall 11 at the channel groove portion 17 of each groove 8; a metal electrode 18 is formed on the upper portion of the unshadowed side wall 11 and the upper portion of the sloping floor at the sloping groove portion 19 of each groove 8; and a metal electrode 9 is formed on the unshadowed side of the side walls 11 and floor at the shallow groove portions 16.

Next, the piezoelectric ceramic plate 2 is rotated 180 degrees and metal electrodes 13, 18, 9, and 10 are formed on opposite side walls, and the like, in the same manner. The metal electrode 10 are then removed from the top of the side walls 11 by lapping or other similar technique. As mentioned previously, the metal electrode 18 of each groove 8 electrically connects the corresponding metal electrode 13 to the corresponding metal electrode 9.

To form the cover plate 3 shown in FIG. 1A, a plate of a resin material, a ceramic material, or other suitable material is cut or ground to form an ink introduction portion 21 and a manifold 22 therein. Then, the side of resultant cover plate 3 with the manifold formed therein is adhered, using an adhesive 4 such as epoxy (see FIG. 5), to the side of the piezoelectric ceramic plate 2 with the grooves formed therein. When covered, the grooves 8 form a plurality of ink chambers 12 (see FIG. 5) which are separated from each other in the horizontal direction at an interval determined by the thickness of the side walls 11.

The nozzle plate 31 is formed from a plastic plate made from polyalkylene terephthalate (for example, polyethylene terephtalate), polyimide, polyether imide, polyether ketone, polyether sulfone, polycarbonate, cellulose acetate, or similar plastic. Nozzles 32 are opened in the nozzle plate 31 at positions thereof corresponding to the positions of the ink chambers 12. The nozzle plate 21 is adhered to the end of the cover plate 3 and the piezoelectric ceramic plate 2 nearest the channel groove portions 17.

The conductor layer patterns 42 are formed in the substrate 41 at positions thereof corresponding to positions of each ink chamber 12. Wire bonding or other similar well-known technique is used to connect conductor wires 43 between conductive layer patterns 42 with respective metal electrodes 9 formed at the floor of the shallow grooves 16. The substrate 41 is then adhered, using an adhesive such as epoxy, to the side of the piezoelectric ceramic plate 2 without grooves 8 formed therein.

Next, an explanation of the operation of the ink jet print head 1 will be provided while referring to FIGS. 5 and 6. All of the ink chambers 12 are filled with ink. The clock line 52 consecutively supplies a clock pulse. Based on the clock pulse and data incoming over the data line 53, the LSI chip 51 determines from which ink chambers 12 ink is to be ejected. In regards to an ink chamber 12 from which is not to be ejected, the LSI chip 51 applies a ground voltage 0 V from the ground line 55 to the metal electrodes 13 of the ink chamber 12 via the corresponding conductive layer pattern 42 and metal electrodes 9 and 18.

In regards to ink chamber 12b from which ink is to be ejected, the LSI chip 51 applies a positive voltage V from the voltage line 52 to the metal electrodes 13*e* and 13*f* via the conductive layer pattern 42 and the metal electrodes 9 and 18 that correspond to the ink chamber 12*b*. At the same time, the LSI chip 51 applies a voltage 0 V from the ground line 55 to the metal electrodes 13*d* and 13*g* via the conductive layer patterns 42 electrically connected to metal electrodes 13 of ink chambers 12 that are not to be driven. As shown in FIG. 6, an electric field is generated in the side wall 11*b* the direction indicated by arrow 14*b*, and an electric field is generated in the side wall 11*c* the direction indicated by arrow 14*c*. Because the electric field directions 14*b* and 14*c* are at right angles to the polarization direction 5, the side walls 11*b* and 11*c* rapidly deform toward the interior of the ink chamber 12*b* by the piezoelectric shear mode effect. The volume of the ink chamber 12*b* reduces as a result, and pressure rapidly increases so that an ink droplet with a predetermined volume is ejected at a predetermined speed from the nozzle 32 connected to the ink chamber 12*b*.

When application of the drive voltage V is stopped, the side walls 11*b* and 11*c* revert to their condition before deforming (see FIG. 5). Ink pressure in the ink chamber 12*b* drops as a result so that ink is drawn into the ink chamber 12*b* from the ink introduction port 21 and the manifold 22.

SUMMARY OF THE INVENTION

The present inventor has found that in this type of ink jet print head, the side wall 11 at the sloping groove portion 19 deforms only slightly when side walls 11*b* and 11*c* are deformed to eject ink from ink chamber 12*b*. Therefore, pressure for ejecting an ink droplet from the ink chamber 12*b* is generated mainly by deformation of the side wall 11 at the channel groove portion 17. An ink droplet is ejected from the nozzle 32 when the ink filling the channel groove portion 17 receives the pressure. Therefore, ink ejection relies only slightly on pressure produced at the sloping groove portion 19 or the shallow groove portion 16.

The present inventor has further found that piezoelectric material forming the side wall 11 acts as a capacitor. Because the entire piezoelectric ceramic plate 2 is made from piezoelectric material, the channel groove portions 17, sloping groove portions 19, and the shallow groove portions 16 all contribute to the capacitance of the capacitor-like side wall 11. However, because the sloping groove portions 19 and the shallow groove portions 16 contribute little to generation of pressure, energy is inefficiently consumed. Therefore, an excessive amount of energy must be inputted to produce a certain amount of pressure.

It is therefore, an object of the present invention to overcome the above-described drawbacks, and to provide an energy efficient print head.

In order to achieve the object and other objects, the present invention provides an ink jet print head for ejecting droplets of ink, comprising: a pair of opposing side walls extending in a first direction 101 and substantially in parallel from a first end to a second end, with a predetermined gap being formed between the pair of opposing side walls, each of the pair of opposing side walls having an opposing side surface and a non-opposing side surface, each of which extends both in the first direction 101 and in a second direction 102 perpendicular to the first direction 101 and has a width in the second direction 102, the width being substantially constant from the first end to a slope start area positioned between the first end and the second end and which narrows between the slope start area and the second end, each of the pair of opposing side walls being made from a piezoelectric material from the first end to the slope start area and being made from a second material with a lower relative dielectric constant than the piezoelectric material from the slope start area to the second end, the piezoelectric material being polarized in the second direction 102 parallel to the opposing and non-opposing side surfaces; two pairs of electrodes, each pair of the electrodes being formed to the opposing side surface and the non-opposing side surface of a corresponding one of the pair of opposing side walls, each pair of the electrodes being for forming an electric field which extends through the piezoelectric material and the second material of the corresponding side wall in a third direction 103 which is perpendicular to both the first direction 101 and second direction 102 and for deforming the corresponding side wall at its portion between the first end and the slope start area upon formation of the electric field; and a cover member for covering the pair of opposing side walls to define an ink chamber between the pair of opposing side walls the cover member, and an ink chamber floor as shown in FIG. 11; for being filled with ink and a nozzle formed at the first end and connected with the ink chamber for jetting droplets of ink filled in the ink chamber.

According to another aspect, the present invention provides an ink jet print head for ejecting droplets of ink, comprising: an actuator constructed from a piezoelectric member made of a piezoelectric material and a capacitance lowering member made of a material with its relative dielectric constant being lower than that of the piezoelectric material, the piezoelectric member having first and second opposite ends in a predetermined direction and the capacitance lowering member having a first and second opposite ends in the predetermined direction, the second end of the piezoelectric member and the first end of the capacitance lowering member being connected with each other along the predetermined direction, the actuator being formed with a plurality of grooves extending in the predetermined direction from the first end of the piezoelectric member to a predetermined position located between the first end and the second end of the capacitance lowering member, a depth of each groove having a predetermined constant value in the piezoelectric member from its first end to its second end and being decreased in the capacitance lowering member from the predetermined value from its first end to its predetermined position; a plurality of electrodes provided on both side surfaces of the plurality of grooves provided in the actuator for forming electric field through the piezoelectric material and the capacitance lowering material located between the electrodes to thereby deform the piezoelectric material; and a cover member for covering the plurality of grooves provided in the actuator to thereby form a plurality of ink chambers for being filled with ink and a plurality of nozzles connected with the plurality of ink chambers for jetting droplets of ink filled in the ink chambers.

According to a further aspect, the present invention provides a method for producing a print head comprising the steps of: preparing a first member formed from piezoelectric material; preparing a second member formed from a material with a relative dielectric constant that is smaller than that of the piezoelectric material; attaching an end of the first member to an end of the second member so that upper surfaces of the first member and the second member are in a planer relationship; cutting grooves in the first member and the second member using dicing techniques so that a groove is formed from one end of the first member to midway in the second member; the grooves corresponding to the floor of the ink chamber; forming electrodes on both side surfaces of the grooves; and covering the grooves to form ink chambers and nozzles.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1A:
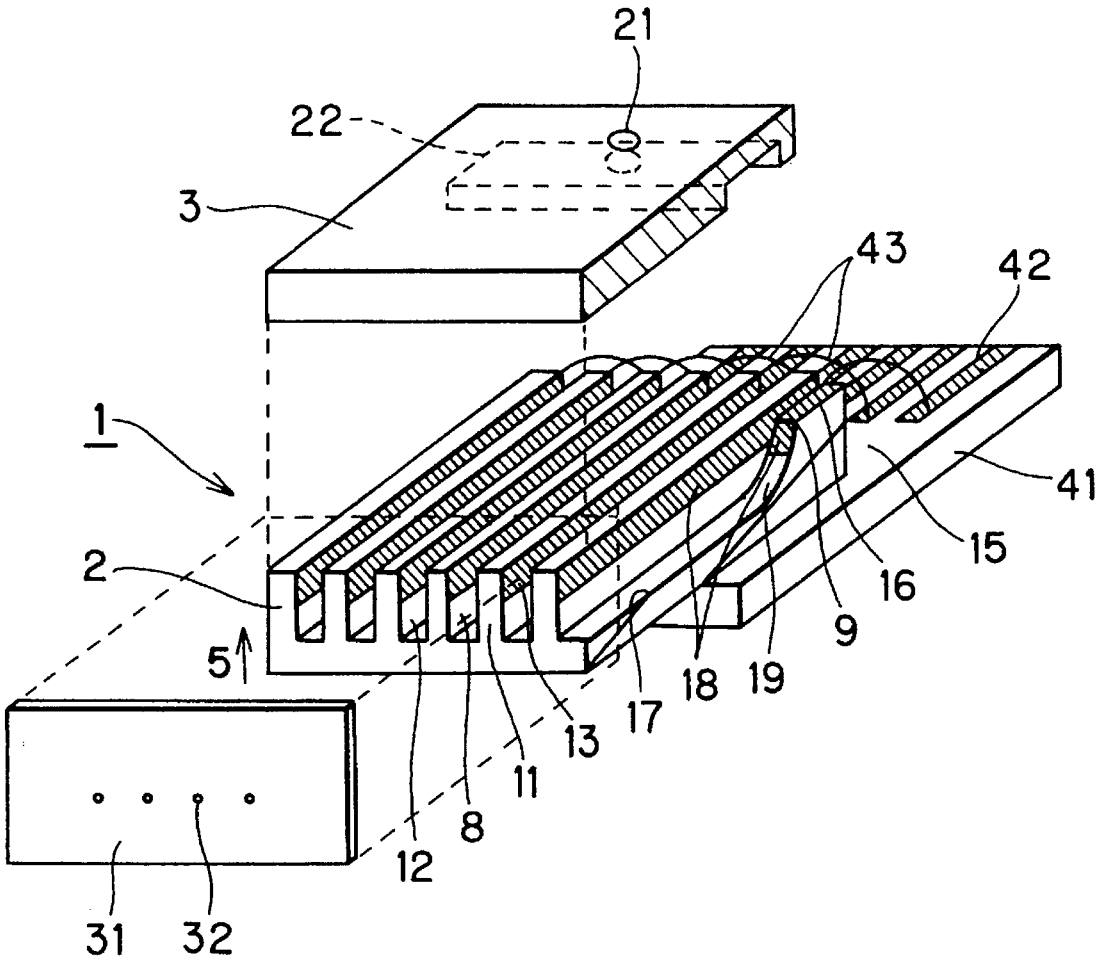
FIG. 1A PRIOR ART
FIG. 1A is a perspective view of a conventional ink jet print head.

A print head according to a preferred embodiment of the present invention will be described while referring to the accompanying drawings wherein like parts and components are designated by the same reference numerals to avoid duplicating description.

Figure 1B:
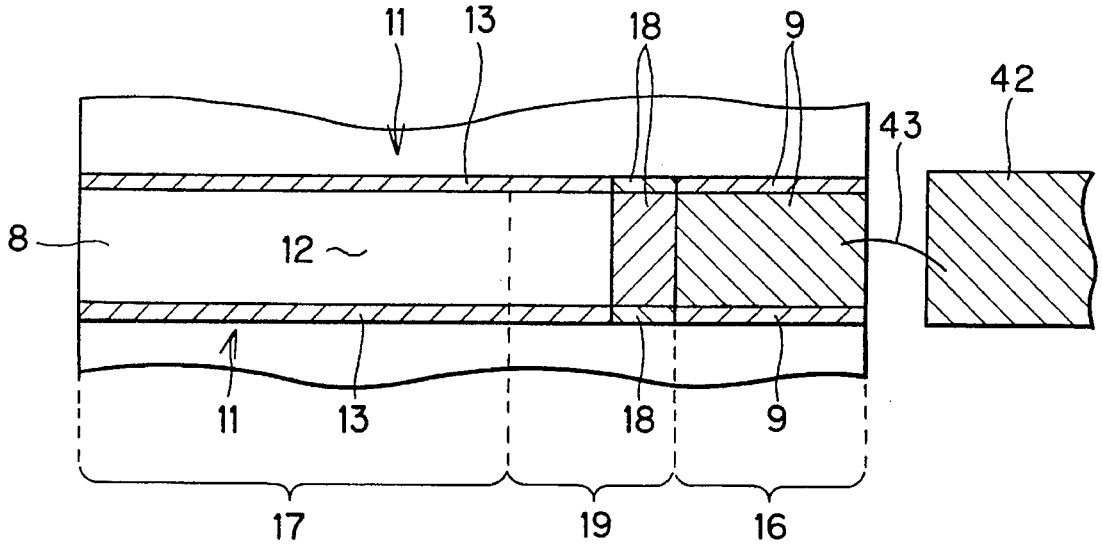
FIG. 1B PRIOR ART
FIG. 1B is a plan view of one groove 8 formed on a piezoelectric ceramic plate of the conventional ink jet print head of FIG. 1A.
Figure 1C:
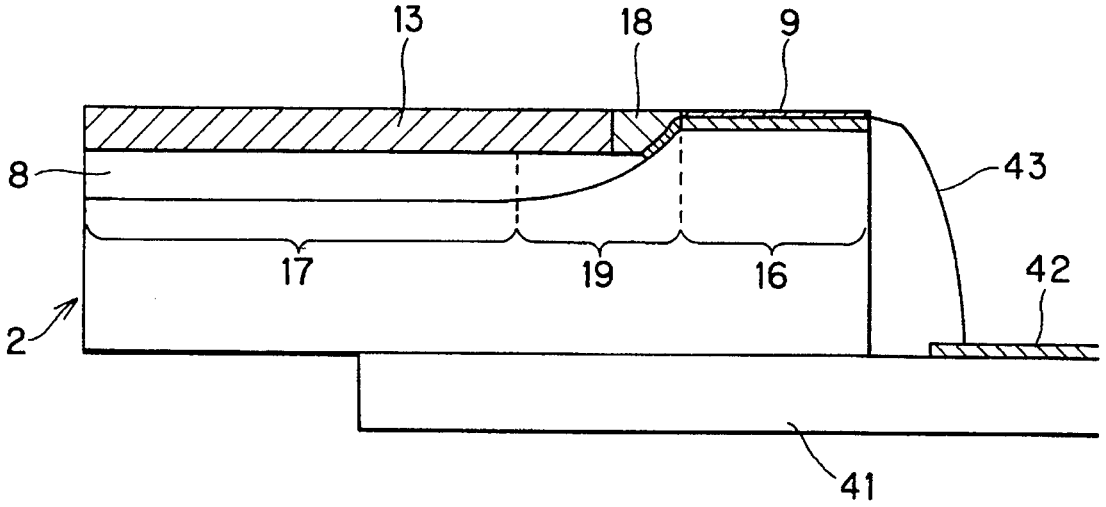
FIG. 1C PRIOR ART
FIG. 1C is a sectional side view of one groove 8 formed on a piezoelectric ceramic plate of the conventional ink jet print head of FIG. 1A.
Figure 10:
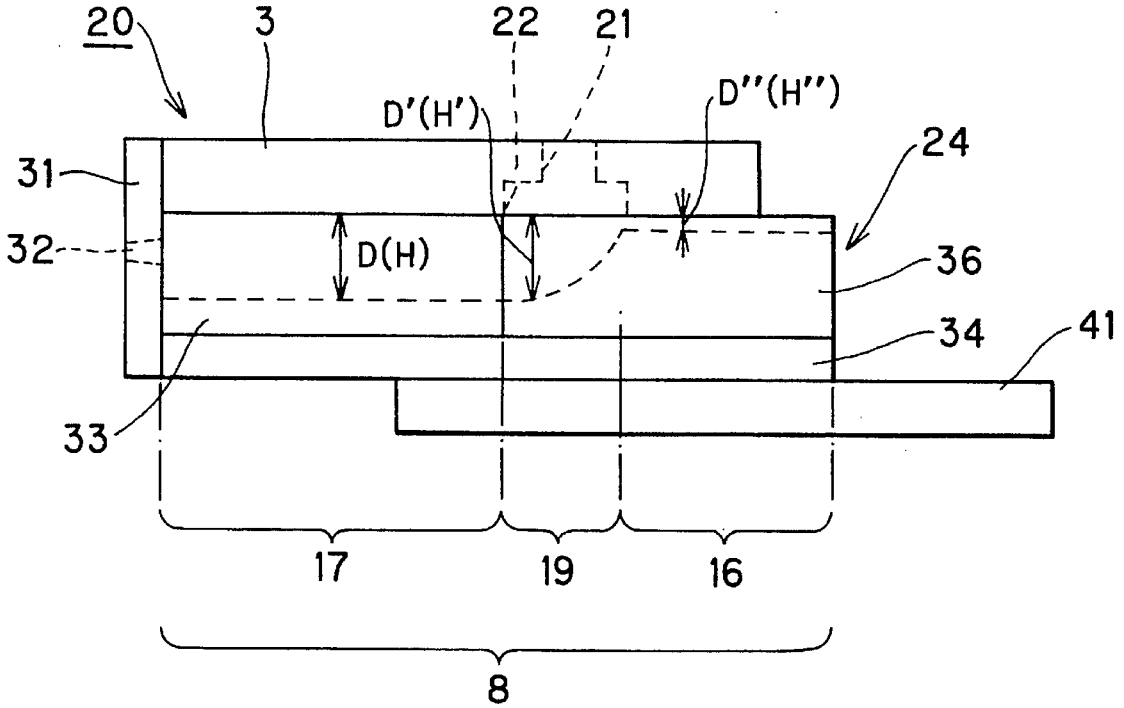
FIG. 10 is an illustrative side view showing an ink jet print head of the present embodiment of the present invention.

An ink jet print head 20 according to the present embodiment is shown in FIG. 10, and includes an actuator 24, a cover plate 3, a nozzle plate 31, and a substrate 41. The ink jet print head 20 of the present invention is similar to the conventional print head 1 shown in FIGS. 1A, 1B and 1C, except that the piezoelectric ceramic element 2 of the conventional print head is replaced with the actuator 24. In other words, the actuator 24, the cover plate 3, the nozzle plate 31, and the substrate 41 are assembled into the ink jet print head 20 of the present invention, in the same manner as shown in FIGS. 1A, 1B and 1C.

Figure 7:
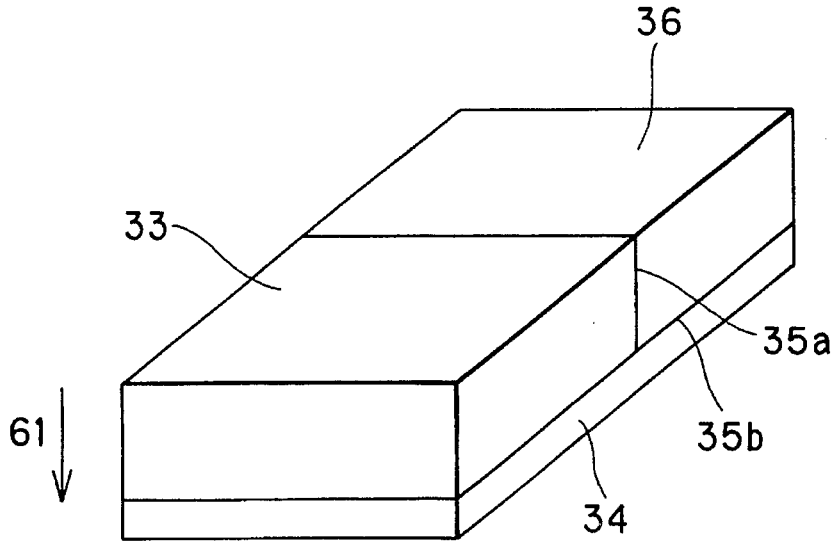
FIG. 7 illustrates a manner how to produce an actuator of a preferred embodiment of the present invention.
Figure 8:
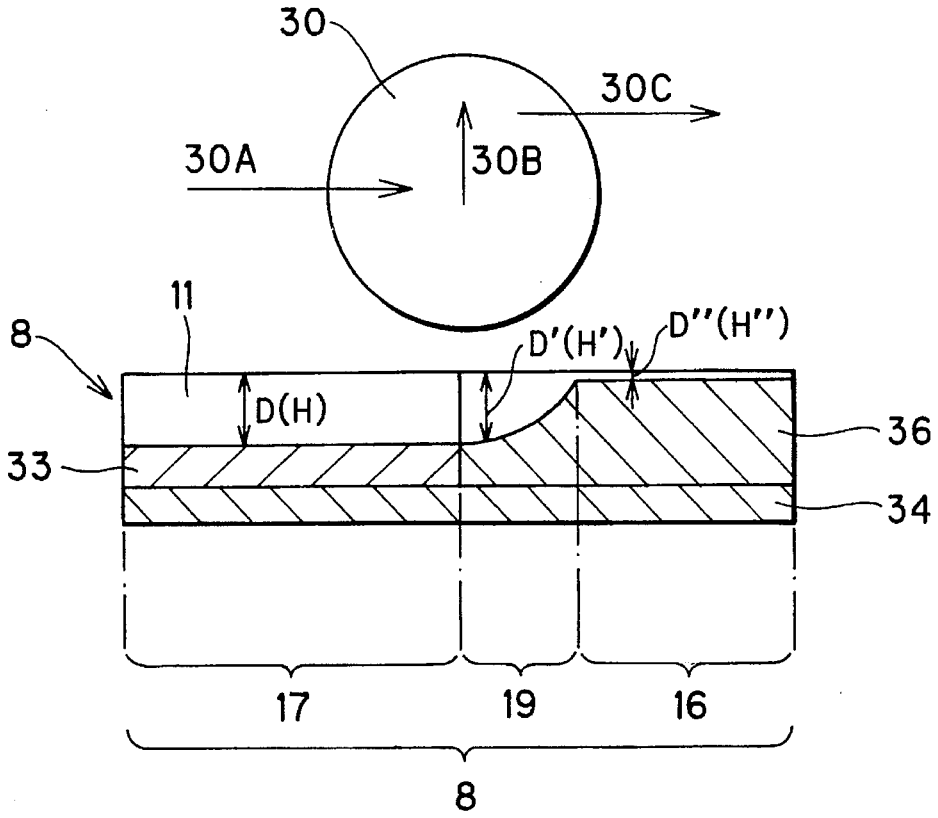
FIG. 8 illustrates a manner how to produce a groove in the actuator produced as shown in FIG. 7 of the present embodiment.
Figure 9:
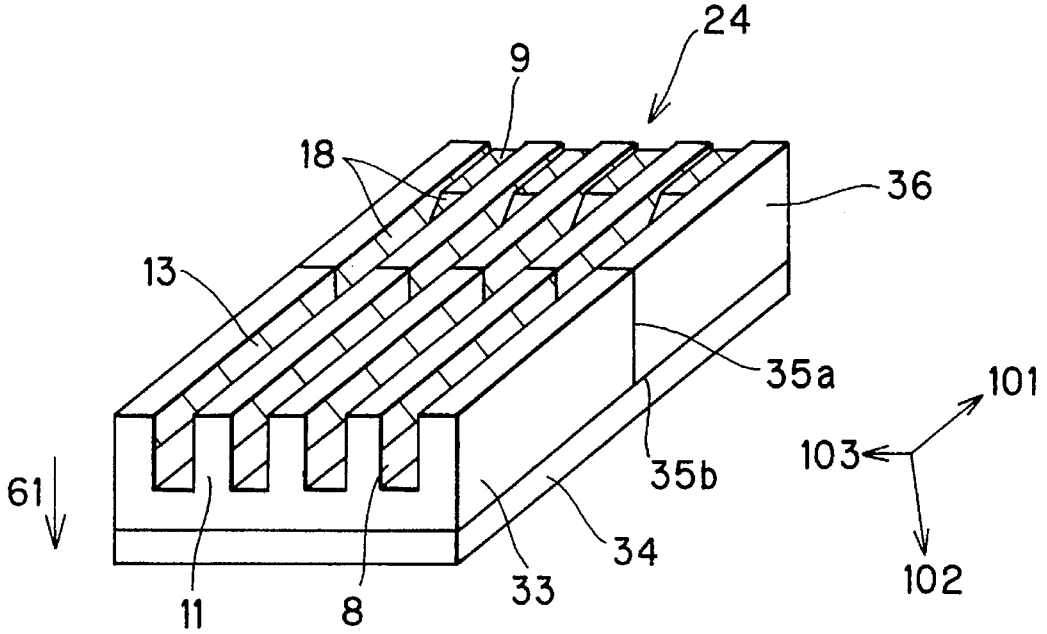
FIG. 9 is a perspective view of the actuator of the present embodiment.

An explanation of a method for producing the actuator 24 will be provided while referring to FIGS. 7, 8, and 9.

First to produce the block shown in FIG. 7, a piezoelectric ceramic substrate 33, that is polarized in the direction indicated by arrow 61, and an alumina ceramic substrate 36 are adhered end to end using an adhesive 35*a* such as epoxy so that their upper surfaces are planer. The alumina ceramic substrate 36 is made from a material, such as alumina ceramics, with a smaller relative dielectric constant (relative permittivity) than the piezoelectric ceramic substrate 33. The adhered piezoelectric ceramic substrate 33 and alumina ceramic substrate 36 unit is then adhered to an alumina ceramic substrate 34 using an epoxy adhesive 35*b*.

Next, as shown in FIG. 8, a plurality of grooves 8 are formed using a diamond cutter blade 30 with a dicing technique. Each groove 8 includes a channel groove portion 17, a sloping groove portion 19, and a shallow groove portion 16.

The channel groove portions 17 are formed in the piezoelectric ceramic substrate 33 by cutting with the diamond cutter blade 30 in the cutting direction indicated by arrow 30A. Next, the depth of cutting is changed by changing the cutting direction from that indicated by arrow 30A to that indicated by arrow 30B. At this point, the central position of the diamond cutter blade 30 aligned with the border between the piezoelectric ceramic substrate 33 and the alumina ceramic substrate 36. Therefore, by changing the cutting direction to that indicated by arrow 30B, the sloping groove portion 19, which has a curved surface with a curvature of the radius of the diamond cutter blade 30, is formed in the alumina ceramic substrate 36. The cutting direction is then changed from that indicated by the arrow 30B to that indicated by arrow 30C so that the shallow groove portion 16 is formed in the alumina ceramic substrate 36.

According to this dicing Operation, each groove 8 is produced so that the channel groove portion 17 has a depth of a substantially constant large value D, the shallow groove portion 16 has a depth D" of a substantially constant small value, and the sloping groove portion 19 has a depth D' decreasing from the large value D to the small value D" so as to connect between the channel groove portion 17 and the shallow groove portion 16. Accordingly, a bottom floor of the groove 8 extends substantially horizontally both in the channel groove portion 17 and the shallow groove portion 16 and is inclined to form a sloped area in the sloping groove portion 19.

In other words, the dicing operation produces a pair of opposing side walls 11 to define each groove 8 therebetween. Each of the opposing side walls 11 has a height H (=D) of a substantially constant large value at the channel groove portion 17, a height H" (=D") of a substantially constant small value at the shallow groove portion 16, and a height H' (=D') decreasing from the large value H to the small value H" at the sloping groove portion 19.

The dimensions of the channel groove portions 17 and the shallow groove portions 16 are determined by the thickness of the diamond cutter blade 30 and the cutting depth set for the diamond cutter blade 30. The pitch of the grooves 8 is determined by the pitch at which the process table feeds the actuator 24. The number of grooves is determined by the number of times cutting processes are repeated on the actuator 24. The curvature of the sloping groove portions 19 is determined by the curvature at the surface of the diamond cutter blade 30, i.e., the radius of the diamond cutter blade 30. The side wall 11 is polarized in the direction indicated by the arrow 61 only at the channel groove portions 17.

Metal electrodes 13, 18, and 9 as shown in FIG. 9 are vapor deposited in the conventional manner using vapor deposition techniques. This completes production of the actuator 24.

Figure 11:
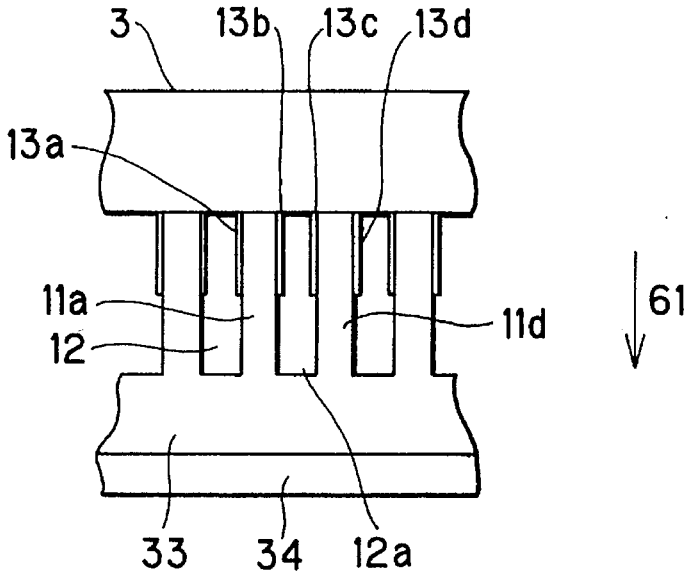
FIG. 11 is a cross-sectional view of the ink jet print head of FIG. 10.

Next, as shown in FIG. 10, the surface of the actuator 24 with grooves 8 cut therein is adhered using an adhesive such as epoxy to the surface of the cover plate 3 with the manifold 22 cut therein. The nozzle plate 31, which is provided with nozzles 32 at positions corresponding to the positions of the ink chambers 12, is adhered to the ends of the piezoelectric ceramic plate 2 and the cover plate 3. In this way, a plurality of ink chambers 12 (see FIG. 11) are formed at a predetermined interval in the ink jet print head 20.

In the same manner as that of the conventional ink jet print head 1 shown in FIG. 1A, the substrate 41 is then adhered using an adhesive such as epoxy to the surface of the piezoelectric ceramic plate 2 without grooves 8 formed therein. Conductor layer patterns 42 are formed in the substrate 41 at positions corresponding to positions of the ink chambers 12. Well-known wire bonding techniques are applied to connect the metal electrodes 9, that are formed to the floor of the shallow groove portions 16, to corresponding conductive layer patterns 42 by conductive wires 43.

Figure 12:
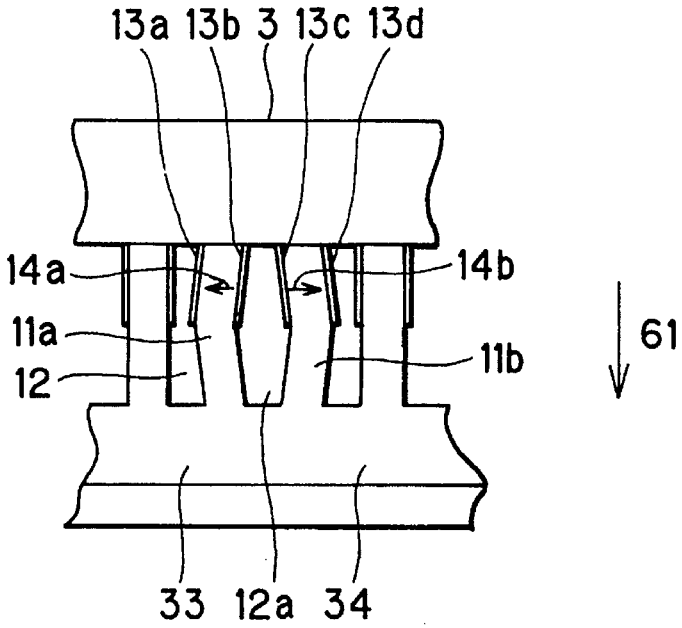
FIG. 12 is a cross-sectional view of the ink jet print head of FIG. 10 showing its operating state.

Next, an explanation of operation of the ink jet print head 20 of the present embodiment constructed as described above will be provided while referring to FIGS. 11 and 12. When, according to incoming data, ink is to be ejected from an ink chamber 12*a* of the ink jet print head 20, a positive drive voltage V is applied to metal electrodes 13*b* and 13*c* via the conductive layer pattern 42, the metal electrode 9, and the metal electrode 18 that correspond to the ink chamber 12*a*. At the same time, metal electrodes 13*a* and 13*d* are connected to a ground. This generates an electric field at the channel groove portion 17 of the side walls 11. As shown in FIG. 12, an electric field is generated at the side wall 11*a* in the direction indicated by arrow 14*a* and at side wall 11*b* in the direction indicated by arrow 14*b*. Because the direction of the electric fields 14*a* and 14*b* are perpendicular to the direction of polarization 61, the side walls 11*a* and 11*b* are rapidly deformed, in this example, toward the exterior of the ink chamber 12*a*, by the piezoelectric shear mode effect. This deformation increases the volume of the ink chamber 12*a*. Pressure in the ink chamber 12*a* decreases as a result. Ink is supplied from an ink supply source (not shown) into the ink introduction port 21 (see FIG. 10), through the manifold 22 (see FIG. 10), through the sloping groove portion 19 of ink chamber 12*a*, and into the channel groove portion 17 of ink chamber 12*a*.

After a predetermined duration of time passes, application of the drive voltage V is stopped. The side walls 11*a* and 11*b* revert to the condition they were in before deforming (see FIG. 11) so that the ink pressure in the channel groove 17 of the ink chamber 12*a* rapidly increases. A pressure wave is generated as a result so that an ink droplet is ejected from the nozzle 32 (see FIG. 10) connected to the ink chamber 12*a*.

In order to drive the ink jet print head 20 to eject ink, a predetermined voltage from a driver must be applied to the portion of the side walls 11 formed from piezoelectric material, that is, the channel groove portion 17 of the side walls 11, according to an inputted signal. The portion of the side walls 11 formed from piezoelectric material acts as a capacitor. The capacitance C is determined using the following equation:

$C=\epsilon_{11}^{T}\times\epsilon_0\times s/t$ wherein $\epsilon_{11}^{T}$ is the relative dielectric constant (relative permittivity) of the piezoelectric material; $\epsilon_0$ is the relative dielectric constant (relative permittivity) of vacuum space; s is surface area of the metal electrode 13; and t is the thickness of the side walls made from the piezoelectric material. Because the side walls 11 of an ink jet print head 20 according to the present embodiment are formed from piezoelectric only at portions thereof that correspond to the channel groove portions 17, the ink jet print head 20 has a lower capacitance C than the conventional print head 1 because the surface area s of the metal electrode 13 is smaller.

It is known that in a print head that is driven using capacitive load in this way, the power P inputted from the driver is proportional to the product of the capacitance and the square of the voltage ($P\propto CV^2$). Therefore, assuming two print heads are driven with the same drive voltage V, the print head with the smaller the capacitance C will require less power. Because the ink jet print head 20 according to the present embodiment has a smaller capacitance C than the conventional ink jet print head 1, the power required to obtain a predetermined ink ejection speed is less in the ink jet print head 20 according to the present embodiment than in the conventional ink jet print head 1.

Trials were performed to compare the characteristics of the ink jet print head 20 of to the present embodiment with the conventional ink jet print head 1. The conventional ink jet print head 1 used in the trials had the structure shown in FIG. 1A and had its side wall 22 polarized in the direction indicated by the arrow 61.

The two ink jet print heads 1 and 20 were produced from a piezoelectric material with dielectric constant $\epsilon_{11}^{T}$ of 2000. The grooves 8 were formed with a depth of 0.5 mm, a pitch of 0.2 mm, and a width of 0.1 mm. Therefore, the thickness (t) of the side wall 11 made from piezoelectric material is 0.1 mm. The channel groove portions 17, the sloping groove portions 19, and the shallow groove portions 16 shown in FIGS. 2 and 8 were formed with a length of 9 mm, 5 mm, and 5 mm respectively. The metal electrodes 13 are formed from the top of the side wall 11 to 0.25 mm from the top of the side wall 11, that is, in a 0.25 mm wide strip along the side wall 11.

The liquid ejected from the ink jet print heads 1 and 20 during the trials was a commonly available ink. The ink jet print heads 1 and 20 were driven with a 50 V drive voltage applied in a rectangular wave pulse. Volume and ejection speed of each of a hundred number of sampled ink droplets were investigated. It was determined that the conventional ink jet print head 1 ejected ink droplets with a volume of 50+/−3 pl ($10^{-12}$ liter) at an ejection speed of 6.24+/−0.35 m/sec and that the ink jet print head 20 of the present embodiment ejected ink droplets with a volume of 49 +/−4 pl at an ejection speed of 6.21+/−0.47 m/sec. These trials showed that when driven by the same drive voltage, ink jet print head 20 of the present embodiment and the conventional ink jet print head 1 eject ink droplets with virtually the same volume at virtually the same ejection speed.

Figure 2:
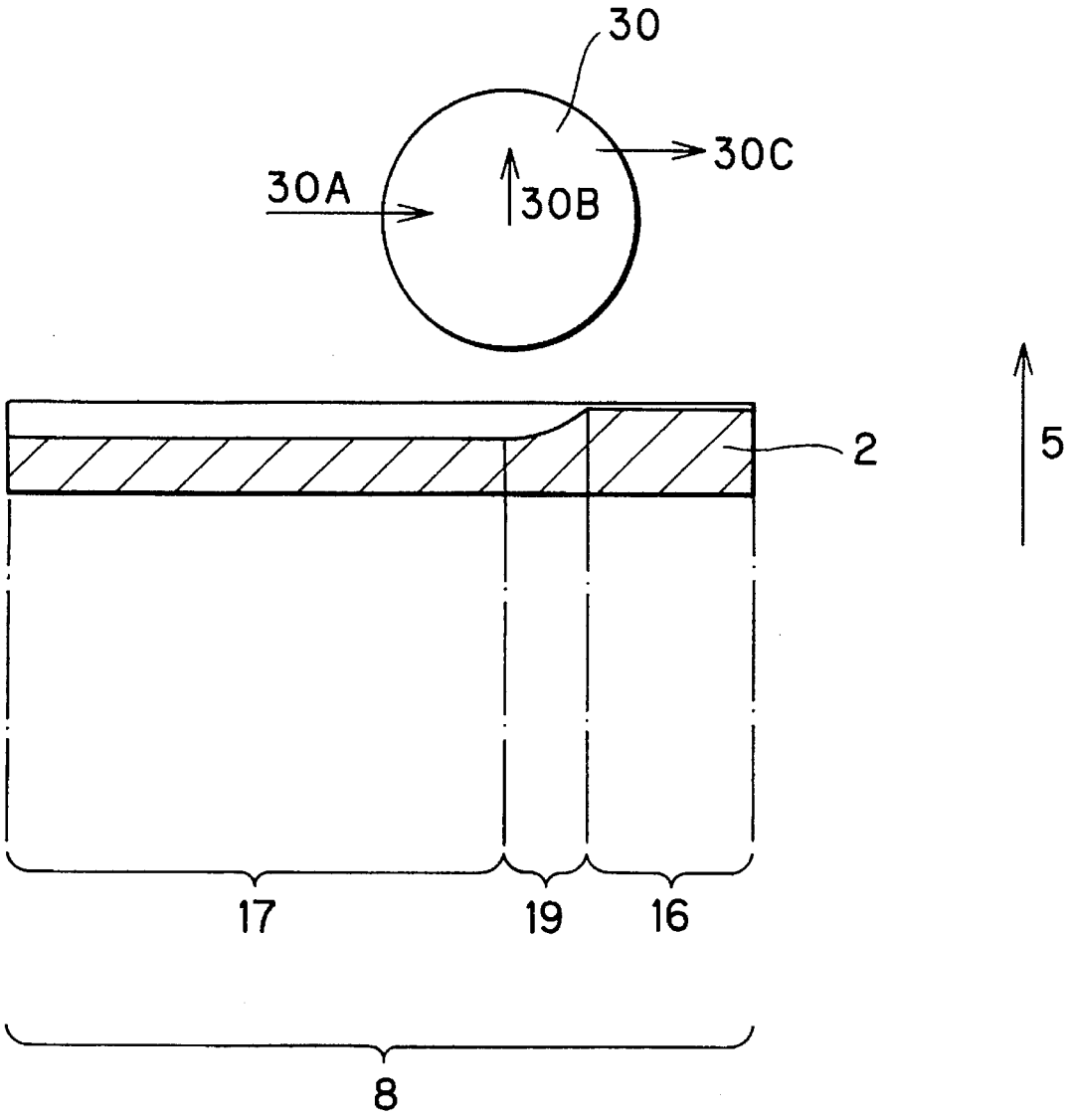
FIG. 2 PRIOR ART
FIG. 2 is a sectional side view illustrating the manner how the grooves are produced in the piezoelectric ceramic plate 2 of FIG. 1A through dicing technique.
Figure 3:
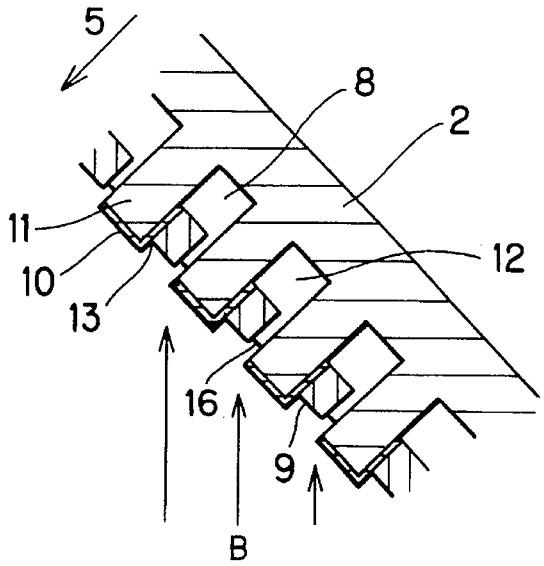
FIG. 3 PRIOR ART
FIG. 3 is a cross-sectional view illustrating the manner how the electrodes are produced on the piezoelectric ceramic plate 2 of FIGS. 1A, 1B and 1C.
Figure 4:
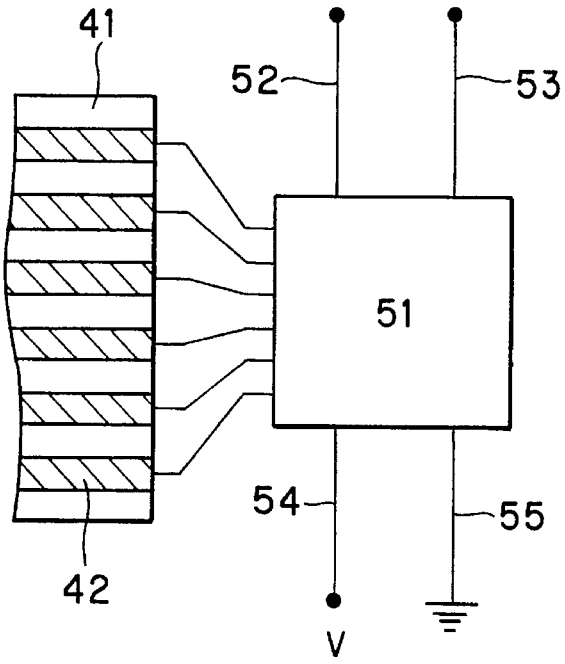
FIG. 4 PRIOR ART
FIG. 4 illustrates a control portion of the ink jet print head.

As mentioned previously, virtually all the pressure for ejecting ink droplets is produced at the channel groove portions 17 of the ink chambers 12 shown in FIGS. 2 and 10. The sloping groove portions 19 and the shallow groove portions 16 contribute little to producing pressure. Therefore, by reducing the capacitance of the sloping groove portions 19 and the shallow groove portions 16, the inputted energy can be more effectively used without sacrificing ink ejection characteristics.

The capacitance of the side wall 11 of a ink jet print head 1 having the above-described dimensions was measured using an LCR meter (a device for measuring inductance, capacitance and resistance) with a measurement voltage of 0.5 V and a measurement frequency of 1 kHz. The result was 0.737 nF. The capacitance of the side wall 11 of the ink jet print head 20 of the present embodiment of the present invention was 0.398 nF. Because the ink jet print heads 1 and 20 have virtually the same ejection characteristics, it can be said that energy inputted to the print head 20 of the present invention was decreased by about 46% in terms of capacitance, relative to the conventional print head 1.

As described above, according to the present embodiment, an actuator is made from a piezoelectric ceramic substrate and an alumina ceramic substrate. The alumina ceramic substrate is made from a material with a dielectric constant that is lower than the piezoelectric material from which the piezoelectric ceramic substrate is made. Using a diamond cutter blade, the actuator is formed with channel groove portions cut in the piezoelectric ceramic substrate, and sloping groove portions and shallow groove portions cut in the alumina ceramic substrate. Metal electrodes are vapor deposited at the inner surface of the shallow groove portions, on the side walls and a portion of the floor of the sloping groove portions, and on the side walls of the channel groove portions. Ink is ejected by deforming the side walls at the channel groove portions, which are made from the piezoelectric ceramic substrate. Because the capacitance of the sloping groove portions and the shallow groove portions is small, only a small amount of energy need be inputted to eject ink droplets.

While the present invention has been described in detail with reference to a specific embodiment thereof, it would be apparent to those skilled in the art that various changes and modifications may be made therein without departing from the spirit of the invention, the scope of which is defined by the attached claims.

For example, the substrate 36 is made from alumina ceramics, because its dielectric constant $\epsilon_s$ of 10 to 15 is smaller than that of the piezoelectric material, which has a dielectric constant $\epsilon_{11}^{T}$ of 2,000. However, other materials, such as borosilicate glass, which has a dielectric constant $\epsilon_s$ of 5 to 10, can be used to produce the substrate 36.

Further, in the present embodiment, the piezoelectric ceramic substrate 33 and the alumina ceramic substrate 36 are adhered to the alumina ceramic substrate 34 with an epoxy adhesive 35*b* and the end of the piezoelectric ceramic substrate 33 is adhered to the end of the alumina ceramic substrate 34 with an epoxy adhesive 35*a*. However, if the adhesive adhering the piezoelectric ceramic substrate 33 to the alumina ceramic substrate 36 produces a sufficiently rigid and sturdy bond, there is not need to provide the alumina ceramic substrate 34. Also, either the piezoelectric ceramic substrate 33 or the alumina ceramic substrate 36 can be formed to a shape that supports the other.

Figure 5:
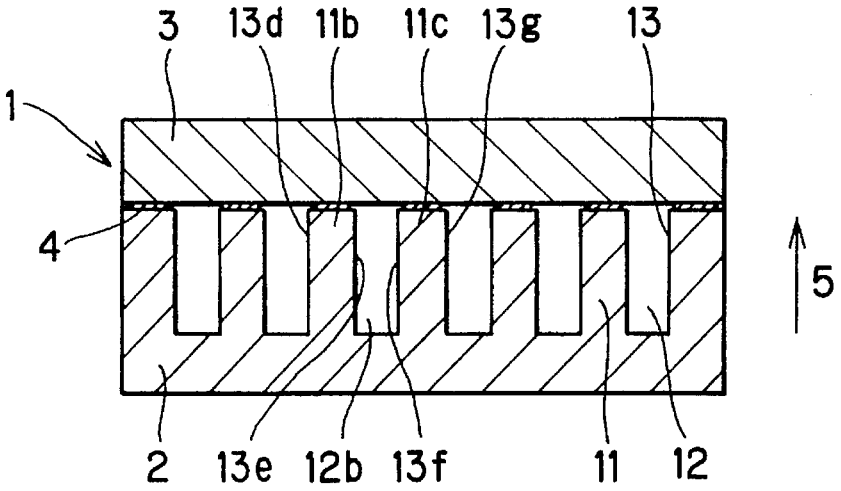
FIG. 5 PRIOR ART
FIG. 5 is a cross-sectional view of the ink jet print head of FIG. 1A.
Figure 6:
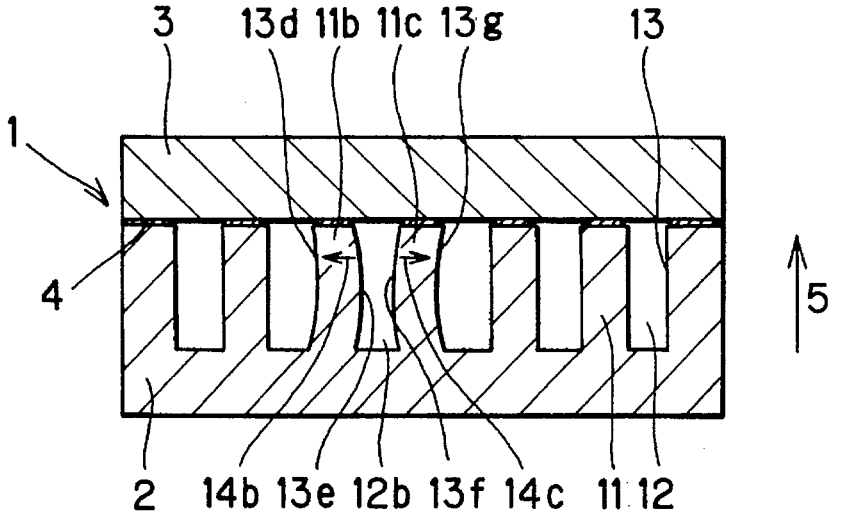
FIG. 6 PRIOR ART
FIG. 6 is a cross-sectional view of the ink jet print head of FIG. 1A showing its operating state.

In the above-described embodiment of the present invention, the piezoelectric ceramic substrate 33 is polarized in a downward direction indicated by an arrow 61. However, the piezoelectric ceramic substrate 33 may be polarized in an upward direction as in the conventional print head of FIGS. 5 and 6 to perform the operation the same as that performed by the conventional print head.

In the above-described embodiment of the present invention, the dicing operation is performed so as to form the sloping groove portion 19 to a curved surface of curvature corresponding to the radius of the used diamond cutter blade. However, the dicing operation can be adjusted so as to form the sloping groove portion 19 to be inclined into any type of curved surface or into a linear surface for linearly connecting the channel groove portion 17 to the shallow groove portion 16.

As described above, according to the present invention, the portion of the side wall corresponding to the inclined floor of the ink chamber (i.e., to the sloping groove portion) in a print head is formed by a material with a smaller dielectric constant than the piezoelectric material. Therefore, the capacitance of the side wall is small at the sloping portion. Therefore, the capacitance of the overall print head is less than the capacitance of conventional heads so that energy is more effectively used.

What is claimed is:

1. An ink jet print head for ejecting droplets of ink through at least one nozzle, comprising:

a pair of opposing side walls extending in a first direction and substantially in parallel with each other from a first end to a second end, with a predetermined gap being formed between said pair of opposing side walls, each of said pair of opposing side walls having an opposing side surface and a non-opposing side surface, each of said opposing and non-opposing side surfaces extending both in the first direction and in a second direction perpendicular to the first direction and having a width in the second direction, the width of each of the opposing and non-opposing side surfaces being substantially constant from the first end to a slope start area positioned between the first end and the second end and being narrow between the slope start area and the second end, each of the pair of opposing side walls comprising a piezoelectric material having a first dielectric constant and a second material with a dielectric constant that is lower than the first dielectric constant of the piezoelectric material, the piezoelectric material being polarized in the second direction parallel to the opposing side surface and the non-opposing side surface;

two pairs of electrodes, each of said pair electrodes being formed on the opposing side surface and the non-opposing side surface of a corresponding one of the pair of opposing side walls, each of said pair of electrodes forming an electric field that extends through the piezoelectric material and the second material of the corresponding one of said pair of opposing side walls in a third direction that is perpendicular to both the first direction and the second direction, said electric field deforming the corresponding one of said pair of opposing side walls between the first end and the slope start area upon formation of the electric field;

a nozzle plate connected to the first end and having at least one nozzle formed therethrough;

a cover member for covering the pair of opposing side walls to define an ink chamber between the pair of opposing side walls and said nozzle plate, said chamber being fillable with ink corresponding to said at least one nozzle formed at the first end and connected with the ink chamber for jetting droplets of ink filled in the ink chamber; and Wherein said one of the pair of opposing side walls includes a portion provided with said two pairs of electrodes, and wherein said portion is made from both the piezoelectric material and the second material.

2. An ink jet print head as claimed in claim 1, wherein the two opposing side walls are made from lead zirconium titanate from the first end to the slope start area and are made from alumina ceramics which has a lower relative dielectric constant than the lead zirconium titanate from the slope start area to the second end.

3. An ink jet print head as claimed in claim 1, wherein the two opposing side walls are made from lead zirconium titanate from the first end to the slope start area and are made from borosilicate glass which has a lower relative dielectric constant than the lead zirconium titanate from the slope start area to the second end.

4. An ink jet print head for ejecting droplets of ink, comprising:

an actuator constructed from a piezoelectric member made of a piezoelectric material and a capacitance lowering member made of a material having a relative dielectric constant lower than that of the piezoelectric material, the piezoelectric member having a first end and a second end opposite said first end in a predetermined direction and capacitance lowering member having a first end and a second end opposite said first end in the predetermined direction, the second end of the piezoelectric member being connected with the first end of the capacitance lowering member along the predetermined direction, the actuator being formed with a plurality of grooves extending in the predetermined direction from the first end of the piezoelectric member to a predetermined position located between the first end and the second end of the capacitance lowering member, a depth of each groove having a predetermined constant value in the piezoelectric member from the first end of the piezoelectric member to the second end of the piezoelectric member and being decreased in the capacitance lowering member from the predetermined value from the first end of the capacitance lowering member to the predetermined position of the capacitance lowering member;

a plurality of electrodes provided on both side surfaces of the plurality of grooves provided in the actuator for forming electric field through the piezoelectric material and the capacitance lowering material located between the electrodes thereby deform the piezoelectric material; and a cover member for covering the plurality of grooves provided in the actuator to thereby form a plurality of ink chambers for being filled with ink and a plurality of nozzles connected with the plurality of ink chambers for jetting droplets of ink filled in the ink chambers.

5. An ink jet print head as claimed in claim 4, wherein the piezoelectric member is formed from lead zirconium titanate, and the capacitance lowering member is formed from alumina ceramics which has a lower relative dielectric constant than the lead zirconium titanate.

6. An ink jet print head as claimed in claim 4, wherein the piezoelectric member is formed from lead zirconium titanate, and the capacitance lowering member is formed from borosilicate glass which has a lower relative dielectric constant than the lead zirconium titanate.

7. A method for producing a print head comprising the steps of:

preparing a first member formed from piezoelectric material;

preparing a second member formed from a material with a dielectric constant that is smaller than a dielectric constant of the piezoelectric material;

attaching an end of the first member to an end of the second member so that upper surfaces of the first member and the second member are in a planer relationship;

cutting grooves in the first member and the second member using dicing techniques so that a groove is formed from one end of the first member to midway in the second member;

forming electrodes on both side surfaces of the grooves; and covering the grooves to form ink chambers and nozzles.

8. A method as claimed in claim 7, wherein the first member is formed from lead zirconium titanate, and the second member is formed from alumina ceramics which has a lower relative dielectric constant than the lead zirconium titanate.

9. A method as claimed in claim 7, wherein the first member is formed from lead zirconium titanate, and the second member is formed from borosilicate glass which has a lower relative dielectric constant than the lead zirconium titanate.

10. An ink jet print head as claimed in claim 1, wherein the piezoelectric material and the second material are arranged in the first direction.

11. An ink jet print head as claimed in claim 10, wherein the interface between the piezoelectric material and the second material is orthogonal to the first direction.

12. An ink jet print head as claimed in claim 11, wherein the piezoelectric material extends from the first end to the slope start area, and the second material extends from the slope start area to the second end.

* * * * *